United States Patent [19]

Cornelius

[11] Patent Number: 4,889,391

[45] Date of Patent: Dec. 26, 1989

[54] HAND-HELD SUCTION DREDGE AND METAL DETECTOR

[76] Inventor: Billie G. Cornelius, 15515 Lee Rd., Houston, Tex. 77032

[21] Appl. No.: 348,594

[22] Filed: May 8, 1989

[51] Int. Cl.[4] ..... E02F 7/00; E02F 3/94; G01V 3/08

[52] U.S. Cl. ..... 299/9; 37/61; 324/326; 15/339

[58] Field of Search ..... 37/58, 61; 324/326–329; 15/339; 299/8–9

[56] References Cited

U.S. PATENT DOCUMENTS

| | | | |
|---|---|---|---|
| 861,859 | 7/1907 | Johnstone | 299/9 |
| 2,028,580 | 1/1936 | Yedd | 37/58 X |
| 3,964,123 | 6/1976 | Pettersson | 15/345 |
| 4,289,355 | 9/1981 | Rose | 37/58 X |
| 4,352,251 | 10/1982 | Sloan | 37/58 |
| 4,359,686 | 11/1982 | Wherry | 324/326 |
| 4,499,713 | 2/1985 | Stone | 56/328.1 |

*Primary Examiner*—Randolph A. Reese
*Assistant Examiner*—Arlen L. Olsen
*Attorney, Agent, or Firm*—Neal J. Mosely

[57] ABSTRACT

A hand-held suction dredge and metal detctor is supported on a vertically held hollow pipe. A metal detector having a central aperture is slidably supported on the pipe with the lower pipe end extending therethrough for receiving and transmitting at least partially fluid material. A spring urges the metal detector toward an initial position at the lower end of said pipe. A fluid jet is positioned in the pipe directed upward therein. A pump supported on the pipe and connected to the fluid jet circulate fluid to create a sucton in the pipe to draw at least partially fluid material through the pipe to discharge the same from the upper end thereof. A perforate basket on the upper end of the pipe has openings sized to permit discharge of fluid material and retain larger metal solids therein. The pipe, in use, supports the metal detector adjacent to a region being investigated for dredging material by operation of the pump. A motor supported on the pipe operates the pump. The dredge and detector are constructed to locate metal objects in sand or loose soil, or underwater, and the pump is a high capacity air blower or water pump, and the jet is of a size and shape to induce suction through the pipe on circulation of air or water therethrough. Circularly extending trays in the basket are positioned to catch and retain solid metal objects drawn through said pipe while allowing fluid or particulate material to flow out through the openings in the basket.

21 Claims, 2 Drawing Sheets

HAND-HELD SUCTION DREDGE AND METAL DETECTOR

BACKGROUND OF THE INVENTION

1. Field of the Invention

This invention relates to metal detection devices and more particularly to a combined hand-held suction dredge and metal detector.

2. Brief Description of the Prior Art

Metal detectors have been in use for some time for locating lost objects such as coins, jewelry and the like. In fact, treasure hunting with metal detectors has become very popular and, in some cases, quite rewarding. Metal detectors are used largely along beaches and in shallow waters to locate and recover objects of precious or semi-precious metal.

Stone U.S. Pat. No. 4,499,713 discloses an air jet and suction device for harvesting nuts from the ground.

Pettersson U.S. Pat. No. 3,964,123 discloses an air jet and suction device for cleaning and for collection of particulate material.

Yedd U.S. Pat. No. 2,028,580 discloses an air jet and suction device used by divers for retrieving material the floor of a sea or ocean.

Hall U.S. Pat. No. 4,622,766 discloses a hand held suction nozzle with metal detector.

SUMMARY OF THE INVENTION

It is therefore an object of the present invention to provide a new and improved metal detection apparatus.

It is another object of this invention is to provide a new and improved combined metal detector and dredge.

Another object of this invention is to provide a new and improved combined metal detector and dredge which is constructed to permit application of the dredge adjacent to the metal detector.

Another object of this invention is to provide a new and improved combined metal detector and dredge which is hand held and constructed to permit application of the dredge adjacent to the metal detector.

Still another object of this invention is to provide a new and improved combined metal detector and dredge which is constructed to permit application of the dredge adjacent to the metal detector which has a fluid operated dredge.

Still another object of this invention is to provide a new and improved combined metal detector and dredge which is constructed to permit application of the dredge adjacent to the metal detector which has a dredge operated by fluid circulated by a pump carried on the apparatus.

A further object of this invention is to provide an improved combined metal detector and dredge which is hand held and has a basket which collects and separates large objects from fluid or particulate matter.

A further object of this invention is to provide an improved combined metal detector and dredge which is hand held and has a basket with circumferential trays which collect and separate large objects from fluid or particulate matter.

Other objects of the invention will become apparent from time to time throughout the specification and claims as hereinafter related.

The above noted objects and other objects of the invention are accomplished by a novel hand-held suction dredge and metal detector supported on a vertically held hollow pipe. A metal detector having a central aperture is slidably supported on the pipe with the lower pipe end extending therethrough for receiving and transmitting at least partially fluid material. A spring urges the metal detector toward an initial position at the lower end of said pipe. A fluid jet is positioned in the pipe directed upward therein. A pump supported on the pipe and connected to the fluid jet circulate fluid to create a suction in the pipe to draw at least partially fluid material through the pipe to discharge the same from the upper end thereof. A perforate basket on the upper end of the pipe has openings sized to permit discharge of fluid material and retain larger metal solids therein. The pipe, in use, supports the metal detector adjacent to a region being investigated for dredging material by operation of the pump. A motor supported on the pipe operates the pump. The dredge and detector are constructed to locate metal objects in sand or loose soil, or underwater, and the pump is a high capacity air blower or water pump, and the jet is of a size and shape to induce suction through the pipe on circulation of air or water therethrough. Circularly extending trays in the basket are positioned to catch and retain solid metal objects drawn through said pipe while allowing fluid or particulate material to flow out through the openings in the basket.

DESCRIPTION OF A PREFERRED EMBODIMENT

Figure 1:
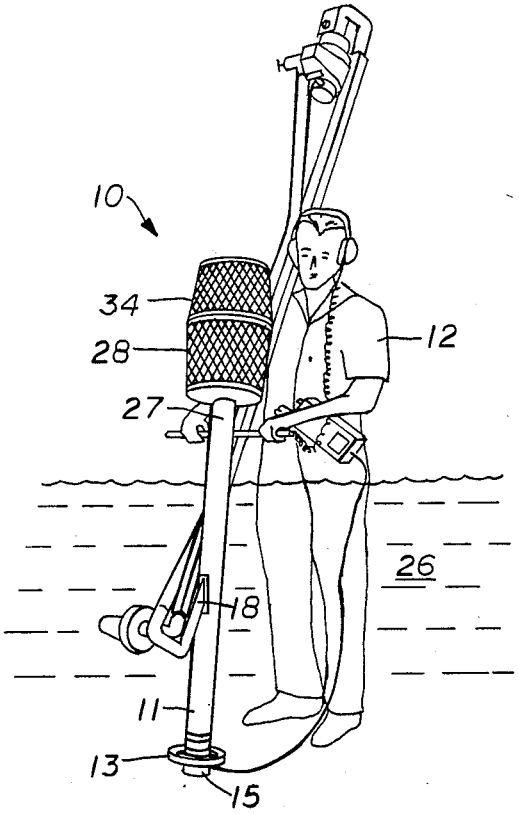
FIG. 1 is a schematic view, in elevation, of a combined metal detector and dredge caried by an operator and positioned for operation in water.
Figure 2:
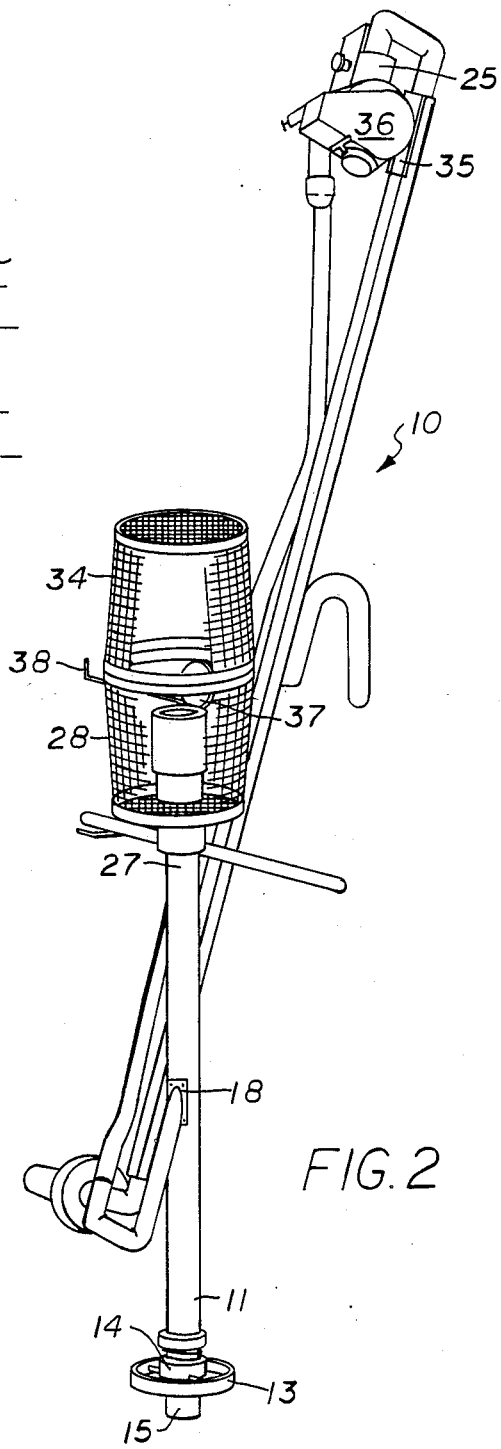
FIG. 2 is a more detailed view, in elevation, of the combined metal detector and dredge shown in FIG. 1.
Figure 3:
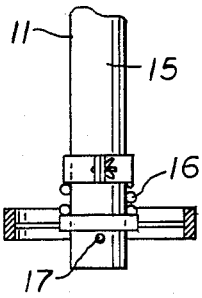
FIG. 3 is a partial elevation of the lower end of the suction pipe of the combined metal detector and dredge shown in FIGS. 1 and 2.
Figure 4:
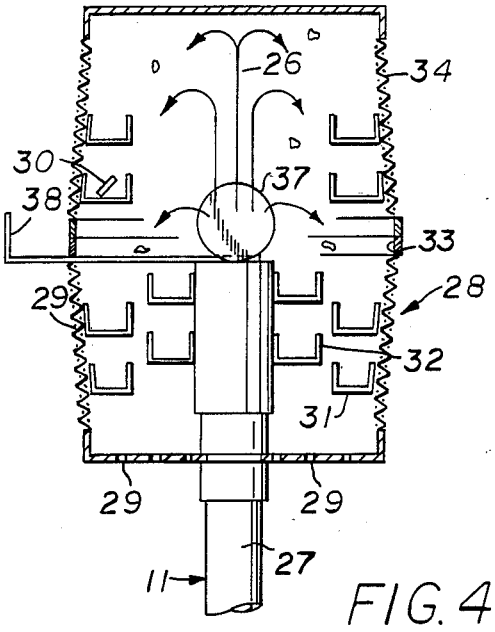
FIG. 4 is a detailed cross section of the collection basket in the combined metal detector and dredge shown in FIGS. 1 and 2.

Referring to the drawings by numerals of reference, and more particularly to FIGS. 1 and 2, there is shown a hand-held suction dredge and metal detector assembly 10 comprising a hollow pipe 11 carried in a substantially vertical position by an operator 12. A metal detector 13 is supported on pipe 11 and slidable thereon. Metal detector 13 is of any suitable, commercially available type, and has a central aperture 14 on which pipe 11 is positioned with the lower pipe end 15 extending therethrough for receiving and transmitting at least partially fluid material from the surface being explored. A spring 16 urges metal detector 13 toward an initial position against a stop 17 at the lower end of pipe 11.

Figure 5:
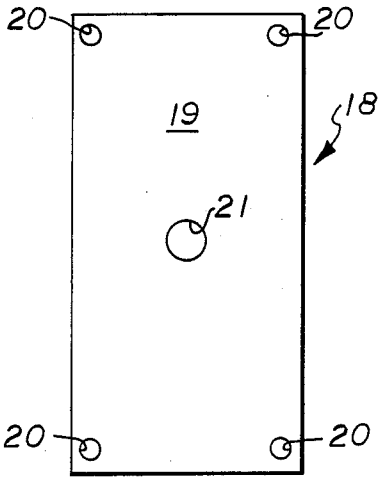
FIG. 5 is detail view of a water jet plate used in the apparatus for underwater operation.
Figure 6:
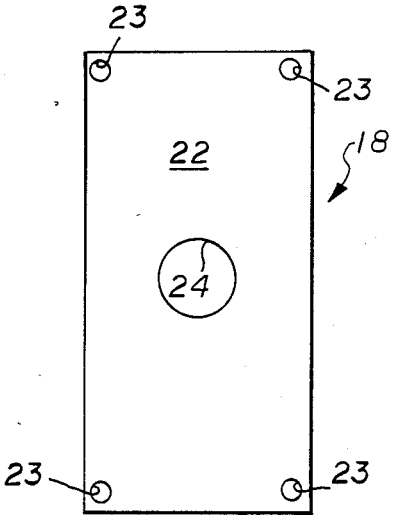
FIG. 6 is detail view of an air jet plate used in the apparatus for operation in loose soil or sand.

A fluid jet member 18 is positioned in pipe 11 directed up ward to induce flow of fluid therein. In FIG. 5, jet member 18 comprises a plate member 19 with peripheral holes 20 for attachment by bolts to pipe 11 and a central jet opening 21 of a small size for circulation of water when the equipment is used under water. In FIG. 6, jet member 18 comprises a plate member 22 with peripheral holes 23 for attachment by bolts to pipe 11 and a central jet opening 24 of a large size for circulation of air when the equipment is used for exploring loose soil or sand.

A pump (for water) or blower (for air) 25 is supported on pipe 11 and connected to fluid jet member 18 to circulate fluid (water or air) to create a suction in pipe 11 and draw at least partially fluid material 26 from bottom end 15 through the pipe to discharge the same from the upper end 27 of the pipe. The support for pump or blower 25 is constructed so that the apparatus can use a pump or blower interchangeably for operation in water or in dry, loose soil or sand. Jet plate members 19 and 22 are likewise interchanged according to whether a pump or blower is used.

A basket 28 is supported on the upper end 27 of pipe 11 and has openings 29 sized to permit discharge of the at least partially fluid material 26 and retain larger metal solids 30 (coins, jewelry, etc.) therein. Basket 28 may be of a woven, screen design with openings 29 being the interstitial spaces. A preferred basket 28 is of a solid wall and bottom design with openings 29 punched or otherwise formed therein. In that form, collection means on the wall of basket 28 retains solid metal objects 30 drawn up through pipe 11 while allowing fluid or articulate material to flow out through the openings 29 in the walls and bottom of the basket. The collection means comprises circularly extending trays 31 which encircle the inner surface of the side wall of basket 28 and circularly extending trays 32 which encircle the outer surface of the upper end 27 of pipe 11 inside said basket. The trays 31 on the basket wall alternate with the trays 32 on the pipe upper end 27. Basket 28 has an open top end 33 with a removable cover 34 permitting access thereto. The upper portion of pipe 11 has a bracket 35 supporting a motor 36 thereon having a flexible shaft operating pump 25.

A flapper member 37 is hingedly attached to the open top end of the pipe 11 and has a lever 38 extending laterally through one side of the basket 28. In normal operation, the flow of fluid (water or air) upward to through the open top end of pipe 11 will maintain the flapper member 37 open. Should the pipe 11 become obstructed by debris, the operator may turn the lever 38 to close off the open end of the pipe with flapper 37 causing the fluid to flow out the open bottom end of the pipe 11 to backwash the system and dislodge the obstruction.

OPERATION

While the operation of this invention should be obvious from the foregoing description, it will be restated for clarity.

Hand-held suction dredge and metal detector assembly 10 comprising a hollow pipe 11, metal detector 13, pump (for water) or blower (for air) 25, fluid jet member 18, and basket 28, is carried in a substantially vertical position by an operator 12. Metal detector 13 is slidably supported on pipe 11 and urged by spring 16 toward an initial position against a stop 17 at the lower end of pipe 11. Metal detector 13 is of any suitable, commercially available type, and has a central aperture 14 in which pipe 11 is positioned with the lower pipe end 15 extending therethrough. The open bottom end of pipe 11 may be extended through metal detector 13 into the silt at the bottom, or floor, of a lake, sea, or ocean at a point where the detector indicated the presence of metal objects to receive and transmitting at least partially fluid material (water, silt and metal objects) from the surface being explored. This construction permits the metal detector to be moved along the bottom of the body of water to a point where metal is detected and the lower end of pipe 11 then inserted into the bottom to collect water, silt and metal objects. Likewise, when operating over loose surface soil or sand, the metal detector may be moved along the surface to a point where metal is detected and the lower end of pipe 11 then inserted into the bottom to collect loose soil or sand and metal objects along with the air used to entrain and collect the same.

Fluid jet member 18, positioned in pipe 11, directs flow of fluid (water or air) upward to induce flow of fluid therein. As previously noted, jet member 18 comprises a plate member 19 with peripheral holes 20 for attachment by bolts to pipe 11 and a central jet opening 21 of a small size for circulation of water when the equipment is used under water or plate member 22 with peripheral holes 23 for attachment by bolts to pipe 11 and a central jet opening 24 of a large size for circulation of air when the equipment is used for exploring loose soil or sand.

Pump (for water) or blower (for air) 25 supported on pipe 11 and connected to fluid jet member 18 circulates fluid (water or air) to create a suction in pipe 11 and draw at least partially fluid material 26 from bottom end 15 through the pipe to discharge the same from the upper end 27 of the pipe into basket 28 on the upper end 27 of pipe 11.

The fluid mixture, i.e. water, silt and metal objects, or air, sand or loose soil, and metal objects, entrained by the water or air flowing through pipe 11 is discharged into basket 28 where the water or air, and silt or sand or loose soil, is discharged through openings 29 and larger metal solids 30 (coins, jewelry, etc.) are retained in circularly extending trays 31 which encircle the inner surface of the side wall of basket 28 and circularly extending trays 32 which encircle the outer surface of the upper end 27 of pipe 11 inside the basket. Top cover 34 is removable to permit access to basket 28 for removal of collected "treasure" 30.

Should the pipe 11 become obstructed by debris, the operator may turn the lever 38 to close off the open end of the pipe 11 with flapper 37 causing the fluid to flow out the open bottom end of the pipe 11 to backwash the system and dislodge the obstruction.

While this invention has been shown fully and completely with special emphasis on certain preferred embodiments, it should be understood that within the scope of the appended claims the invention may be practiced otherwise than as specifically described herein.

I claim:

1. A hand-held suction dredge and metal detector comprising a hollow pipe adapted to be carried in a vertical position, a metal detector having a central aperture supported for sliding movement on said pipe with the lower pipe end extending therethrough for receiving and transmitting at least partially fluid material therethrough, spring means urging said metal detector toward an initial position at the lower end of said pipe, fluid jet means positioned in said pipe directed upward therein, pump means supported by said pipe and connected to said fluid jet means to circulate fluid therethrough to create a suction in said pipe to draw at least partially fluid material from said bottom end through said pipe to discharge the same from the upper end of said pipe, and basket means supported on the upper end of said pipe having openings sized to permit discharge of at least partially fluid material and retain larger metal solids therein, said pipe being operable in use to support said metal detector adjacent to a region being investigated and to dredge material therefrom by operation of said pump means and, a motor means supported by said pipe above the upper end of said pipe for operating said pump means.

2. A hand-held suction dredge and metal detector according to claim 1 in which said dredge and detector are constructed to locate metal objects in sand or lose soil, said pump means is a high capacity air blower, and said jet means is of a size and shape to induce suction through said pipe on circulation of air therethrough by said blower.

3. A hand-held suction dredge and metal detector according to claim 1 in which said dredge and detector are constructed to locate metal objects underwater, said pump means is a water pump, and said jet means is of a size and shape to induce suction through said pipe on circulation of water therethrough by said pump.

4. A hand-held suction dredge and metal detector according to claim 1 in which said metal detector is movable along said pipe a distance sufficient to permit the lower end of said pipe to penetrate the region being searched to draw material from beneath the surface.

5. A hand-held suction dredge and metal detector according to claim 1 in which said dredge and detector are constructed to locate metal objects in sand or lose soil, said pump means is a high capacity air blower, said jet means is of a size and shape to induce suction through said pipe on circulation of air therethrough by said blower, and said metal detector is movable along said pipe a distance sufficient to permit the lower end of said pipe to penetrate the loose soil or sand being searched to draw material from beneath the surface.

6. A hand-held suction dredge and metal detector according to claim 1 in which said dredge and detector are constructed to locate metal objects underwater, said pump means is a water pump, said jet means is of a size and shape to induce suction through said pipe on circulation of water therethrough by said pump, and said metal detector is movable along said pipe a distance sufficient to permit the lower end of said pipe to penetrate the bottom of the body of water being searched to draw material from beneath the surface thereof.

7. A hand-held suction dredge and metal detector according to claim 1 in which said basket means comprises hollow basket having side walls and a bottom wall of perforate material and an open top for removal of material collected therein, said pipe upper end extending through said basket bottom wall to discharge material into said basket

8. A hand-held suction dredge and metal detector according to claim 7 in which said basket has a removable cover permitting access to said open top.

9. A hand-held suction dredge and metal detector according to claim 7 including collection means on the wall of said basket to retain solid metal objects drawn up through said pipe while allowing fluid or particulate material to flow out through the openings in the walls and bottom of said basket.

10. A hand-held suction dredge and metal detector according to claim 1 in which said basket means comprises a hollow basket having side walls and a bottom wall of perforate material and an open top for removal of material collected therein, said pipe upper end extending through said basket bottom wall to discharge material into said basket, and a plurality of circularly extending trays in said basket positioned to catch and retain solid metal objects drawn up through said pipe while allowing fluid or particulate material to flow out through the openings in the walls and bottom of said basket.

11. A hand-held suction dredge and metal detector according to claim 10 in which said circularly extending trays encircle the inner surface of the basket side wall and the outer surface of the upper end of said pipe inside said basket, the trays on said basket wall alternating with the trays on said pipe.

12. A hand-held suction dredge and metal detector according to claim 10 in which said basket material is a perforate mesh or screen.

13. A hand-held suction dredge and metal detector according to claim 10 in which said basket material is a solid sheet material with perforations therein.

14. A hand-held suction dredge and metal detector according to claim 1 including said dredge and detector are constructed to locate metal objects in sand or lose soil, said pump means is a high capacity air blower, said jet means is of a size and shape to induce suction through said pipe on circulation of air therethrough by said blower, said basket means comprises a hollow basket having side walls and a bottom wall of perforate material and an open top for removal of material collected therein, said pipe upper end extending through said basket bottom wall to discharge material into said basket, and a plurality of circularly extending trays in said basket positioned to catch and retain solid metal objects drawn up through said pipe while allowing fluid or particulate material to flow out through the openings in the walls and bottom of said basket.

15. A hand-held suction dredge and metal detector according to claim 14 in which said circularly extending trays encircle the inner surface of the basket side wall and the outer surface of the upper end of said pipe inside said basket, the trays on said basket wall alternating with the trays on said pipe.

16. A hand-held suction dredge and metal detector according to claim 1 in which said dredge and detector are constructed to locate metal objects underwater, said pump means is a water pump, said jet means is of a size and shape to induce suction through said pipe on circulation of water therethrough by said pump, said basket means comprises a hollow basket having side walls and a bottom wall of perforate material and an open top for removal of material collected therein, said pipe upper end extending through said basket bottom wall to discharge material into said basket, and a plurality of circularly extending trays in said basket positioned to catch and retain solid metal objects drawn up through said pipe while allowing fluid or particulate material to flow out through the openings in the walls and bottom of said basket.

17. A hand-held suction dredge and metal detector according to claim 16 in which said circularly extending trays encircle the inner surface of the basket side wall and the outer surface of the upper end of said pipe inside said basket, the trays on said basket wall alternating with the trays on said pipe.

18. A hand-held suction dredge and metal detector according to claim 16 in which said basket material is a perforate mesh or screen.

19. A hand-held suction dredge and metal detector according to claim 16 in which said basket material is a solid sheet material with perforations therein.

20. A hand-held suction dredge and metal detector according to claim 1 including backwashing means supported on the upper end of said pipe means for backwashing said pipe means.

21. A hand-held suction dredge and metal detector according to claim 20 in which said backwashing means is a flapper member hingedly connected to the top end of said pipe with a lever member extending laterally therefrom to the exterior of said basket means for pivotally moving said flapper member to a closed position covering the open top end of said pipe means, whereby fluid is discharged through said bottom end of said pipe to dislodge obstructions therein.

* * * * *